US009803440B2

(12) United States Patent
Eldho et al.

(10) Patent No.: US 9,803,440 B2
(45) Date of Patent: Oct. 31, 2017

(54) SETTING A DOWNHOLE TOOL IN A WELLBORE

(71) Applicant: Halliburton Energy Services, Inc., Houston, TX (US)

(72) Inventors: Shanu Thottungal Eldho, Singapore (SG); Michael Dale Ezell, Carrollton, TX (US); Shane Robert Burckhard, Sanger, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/911,105

(22) PCT Filed: Mar. 9, 2015

(86) PCT No.: PCT/US2015/019457

§ 371 (c)(1),
(2) Date: Feb. 9, 2016

(87) PCT Pub. No.: WO2016/144314

PCT Pub. Date: Sep. 15, 2016

(65) Prior Publication Data

US 2017/0037692 A1 Feb. 9, 2017

(51) Int. Cl.

| | |
|---|---|
| ***E21B 23/01*** | (2006.01) |
| ***E21B 23/02*** | (2006.01) |
| ***E21B 43/10*** | (2006.01) |
| ***E21B 23/00*** | (2006.01) |
| *E21B 23/06* | (2006.01) |
| *E21B 33/12* | (2006.01) |

(52) U.S. Cl.
CPC ..... *E21B 23/01* (2013.01); *E21B 23/00* (2013.01); *E21B 23/02* (2013.01); *E21B 23/06* (2013.01); *E21B 33/12* (2013.01); *E21B 43/10* (2013.01)

(58) Field of Classification Search
CPC ..... E21B 23/01; E21B 23/02; E21B 43/10
See application file for complete search history.

(56) References Cited

U.S. PATENT DOCUMENTS

| | | | | |
|---|---|---|---|---|
| 2,189,702 | A * | 2/1940 | Burt | E21B 33/1294 166/122 |
| 2,368,399 | A * | 1/1945 | Baker | E21B 33/1204 166/122 |
| 5,425,418 | A | 6/1995 | Arizmendi et al. | |
| 7,080,693 | B2 | 7/2006 | Walker et al. | |

(Continued)

OTHER PUBLICATIONS

PCT International Search Report and Written Opinion of the International Searching Authority, PCT/US2015/019457, dated Nov. 18, 2015, 11 pages.

*Primary Examiner* — Giovanna C Wright
(74) *Attorney, Agent, or Firm* — Scott Richardson; Parker Justiss, P.C.

(57) ABSTRACT

A downhole tool setting system includes a tubular member that defines a bore therethrough; a downhole tool positioned to ride the tubular member between a partial set position and a final set position; and a locking system coupled to the downhole tool and configured to adjust the downhole tool from the partial set position based on at least a portion of the locking system moveable relative to the tubular member to the final set position based on at least a portion of the locking system affixed to the tubular member.

19 Claims, 7 Drawing Sheets

(56) References Cited

U.S. PATENT DOCUMENTS

| | | | |
|---|---|---|---|
| 2005/0056417 | A1 | 3/2005 | Porter et al. |
| 2010/0307767 | A1 | 12/2010 | Fay et al. |
| 2010/0314135 | A1 | 12/2010 | Carisella et al. |
| 2014/0014353 | A1 | 1/2014 | Rios, III |

* cited by examiner

SETTING A DOWNHOLE TOOL IN A WELLBORE

This application is a U.S. National Phase Application under 35 U.S.C. §371 and claims the benefit of priority to PCT Application Serial No. PCT/US2015/019457, filed on Mar. 9, 2015, the contents of which are hereby incorporated by reference.

TECHNICAL BACKGROUND

This disclosure relates to a locking system (e.g., a body lock system, mandrel cinch, or mandrel lock) for a downhole well tool.

BACKGROUND

Downhole tools are often run into a wellbore and positioned at a particular position (e.g., vertically) within the wellbore prior to actuation. In some instances, the particular position at which a downhole tool is set may require some adjustment and even deviation from a specified position. But, in some cases, a downhole tool (e.g., a packer, plug, hanger, or otherwise) that is set may need to be positionally adjusted after setting, thereby requiring additional time and effort.

DETAILED DESCRIPTION

The present disclosure relates to a locking system for a downhole well system. In example implementations, a locking system coupled to a downhole tool may be adjusted to a partial set position, where the downhole tool is partially set at a particular location in a wellbore, as well as a final set position, in which the downhole tool is set at a final location in a wellbore and may be then actuated (e.g., as a packer, plug, hanger, or otherwise). In the partial set position, a body lock ring of the locking system may move (e.g., uphole or downhole) relative to a mandrel on which portions of the locking system and downhole tool may ride. In the final set position, the body lock ring may be affixed (e.g., through engaged threads or profiles) to the mandrel, thereby setting the position of the downhole tool.

Various implementations of a locking system according to the present disclosure may include one, some, or all of the following features. For example, temporary partial set of packer assemblies, tubing anchor assemblies, hangers, bridge plugs, sub-surface safety systems, travel joints and PBA etc. In the event where multiple partial sets are needed to determine setting location prior final space out and set, this invention allows partial set without fully engaging the body lock ring. While retained to the carrier ring the body lock ring can remain inactive or provide a unidirectional movement until the final set is complete. This feature allows for the repeated partial sets and releases prior to the final set of the packer. The invention disclosed here allows flexibility as to the length the thread profile has to be machined on the mandrel. Incorporates a no-go feature onto the locking system. In another example, the locking system may facilitate a precise manipulation of a downhole tool prior to a final setting location. Further, locking system may facilitate or control a sequencing of events, such as, for example, a shear sequence, a shift sequence, or other sequence.

The details of one or more implementations of the present disclosure are set forth in the accompanying drawings and the description below. Other features and advantages of the present disclosure will be apparent from the description and drawings, and from the claims.

Figure 1:
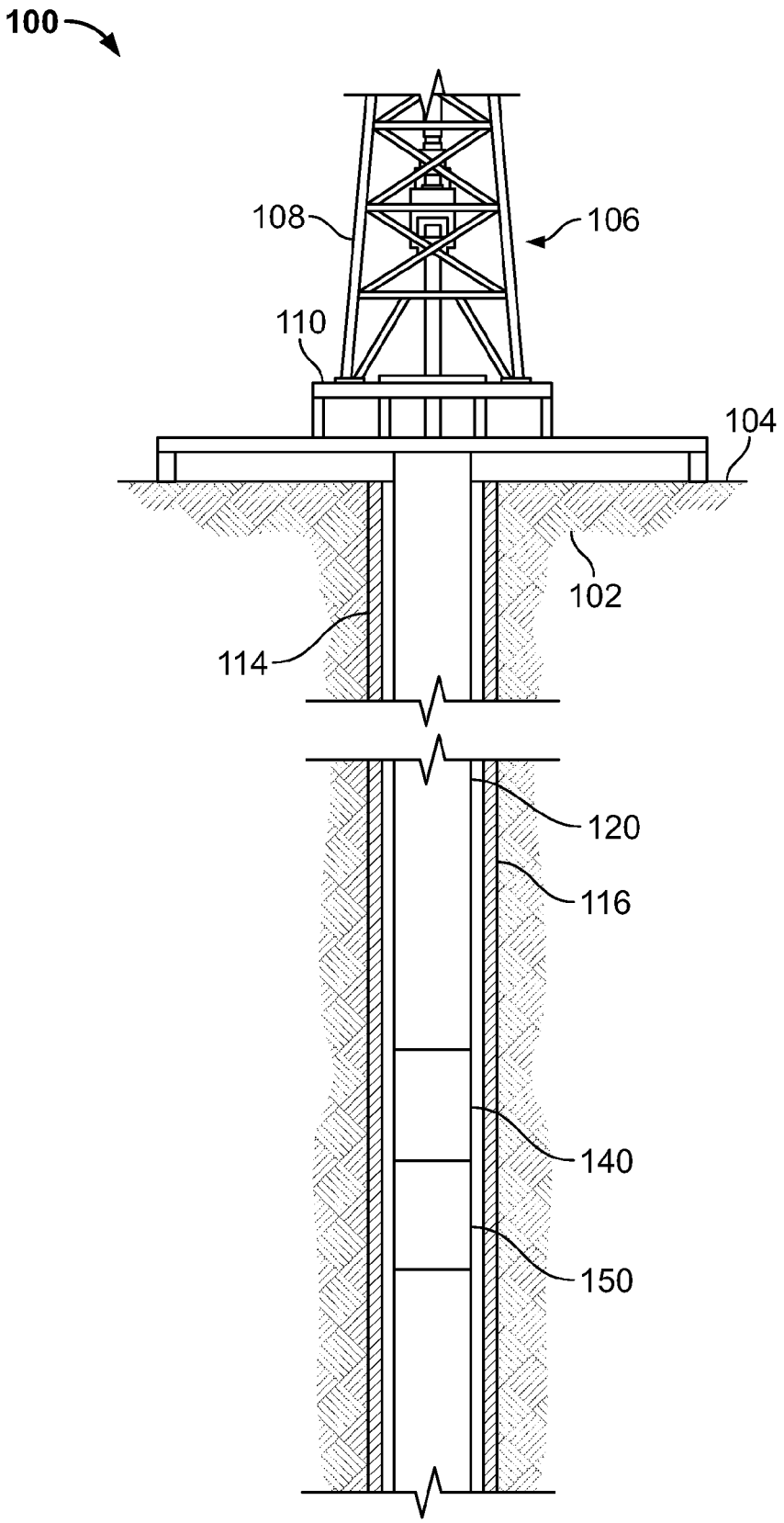
FIG. 1 illustrates a schematic view of an example well system that includes a locking system.

FIG. 1 illustrates a cross-section view of an example well system 100 that includes a locking system 150. As depicted, the operating environment comprises a workover or drilling rig 106 that is positioned on the earth's surface 104 (e.g., a terranean surface or a sub-sea surface) and extends over and around a wellbore 114 that penetrates a subterranean formation 102 for the purpose of recovering hydrocarbons. The wellbore 114 may be drilled into the subterranean formation 102 using any suitable drilling technique. The illustrated wellbore 114 extends substantially vertically away from the earth's surface 104 over a vertical wellbore portion 116. In alternative operating environments, all or portions of the wellbore 114 may be vertical, deviated at any suitable angle, horizontal, or curved. The wellbore 114 may be a new wellbore, an existing wellbore, a straight wellbore, an extended reach wellbore, a sidetracked wellbore, a multilateral wellbore, and other types of wellbores for drilling and completing one or more production zones. Further the wellbore 114 may be used for both producing wells and injection wells, and may be completely cased, partially cased, or open hole (e.g., uncased).

A wellbore tubular string 120 that includes the locking system 150 may be lowered into the subterranean formation 102 for a variety of purposes (e.g., injecting or producing fluids from the wellbore, workover or treatment procedures, etc.) throughout the life of the wellbore 114. The implementation shown in FIG. 1 illustrates the wellbore tubular 120 in the form of a tubing string that includes a downhole tool 140 disposed in the wellbore 114. The downhole tool 140, in this example implementation, is a settable tool, such as, for example, a packer assembly or other sealing element, an anchor assembly (e.g., tubing anchor), a hanger or hangers, a bridge (or other type of) plug, a travel joint, or other settable tools. For instance, in some implementations, the downhole tool 140 may be adjusted (e.g., set) between two or more positions (e.g., an actuated position and an unactuated position) by the locking system 150. Further, in some implementations, the downhole tool 140 may need to be locationally adjusted (e.g., within the wellbore 114) before being set by the locking system 150. The locking system 150 may, therefore, partially set the downhole tool 140 prior to a final setting.

The wellbore tubular 120 that includes the locking system 150 is equally applicable to any type of wellbore tubular being inserted into a wellbore as part of a procedure needing fluid isolation from above or below the ball valve, including as non-limiting examples drill pipe, segmented pipe, casing, rod strings, and coiled tubing. Further, techniques of isolating the interior of the wellbore tubular string 120 from the annular region between the wellbore tubular string 120 and the wellbore wall 114 may take various forms. For example, a zonal isolation device such as a packer (e.g., the downhole tool 140), may be used to isolate the interior of the wellbore tubular string 120 from the annular region (e.g., between the tubular string 120 and the wellbore 114 (or casing within the wellbore 120).

In this illustrated example, the workover or drilling rig 106 may comprise a derrick 108 with a rig floor 110 through which the wellbore tubular 120 extends downward from the drilling rig 106 into the wellbore 114. The workover or drilling rig 106 may comprise a motor driven winch and other associated equipment for extending the wellbore tubular 120 into the wellbore 114 to position the wellbore tubular 120 at a selected depth. While the operating environment depicted in FIG. 1 refers to a stationary workover or drilling rig 106 for conveying the wellbore tubular 120 comprising the locking system 150 within a land-based wellbore 114, in alternative implementations, mobile workover rigs, wellbore servicing units (such as coiled tubing units), and the like may be used to lower the wellbore tubular 120 comprising the locking system 150 into the wellbore 114. The wellbore tubular 120 comprising the locking system 150 may alternatively be used in other operational environments, such as within an offshore wellbore operational environment.

Regardless of the type of operational environment in which the locking system 150 is used, the locking system 150 may set or sequentially set (e.g., on a timed schedule or otherwise) the downhole tool 140 to a particular state (e.g., an actuated state) so that the downhole tool 140 can further function (e.g., seal an annulus, plug a tubular, or otherwise). In some aspects, setting may not be limited to setting the downhole tool 140 but instead, setting may be achieved by axial movement of the wellbore tubular 120.

The locking system 150 may also axially (e.g., uphole or downhole) move the downhole tool 140 to adjust the downhole tool 140 to a final (or specified) wellbore location. For instance, in the event where the downhole tool 140 may need to be partially set (e.g., one or multiple instances) in order to determine a final setting location within the wellbore 114, the locking system 150 may facilitate a partial set without fully committing the downhole tool 140 to a temporary location within the wellbore 114.

The locking system 150 may also comprise components (e.g., a threaded connection) located above or below the locking system 150 to allow the locking system 150 to be disposed within or coupled to a wellbore tubular or other wellbore components (e.g., production subs, downhole tools, screens, etc.), for example, to form a workstring, production string, conveyance string, etc.

Figure 2A:
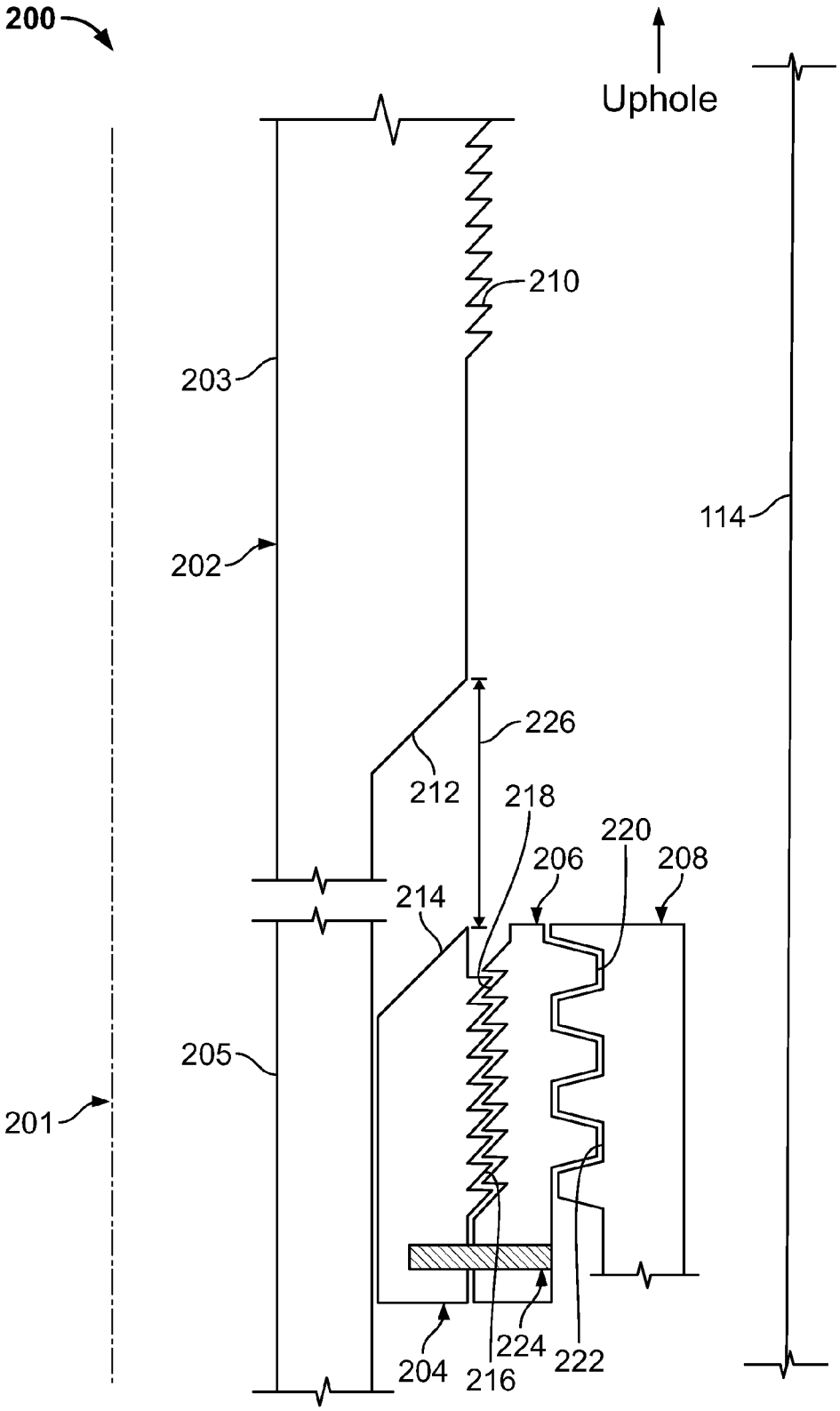
FIGS. 2A-2B illustrate a schematic cross-section view of a portion of an example locking system.
Figure 2B:
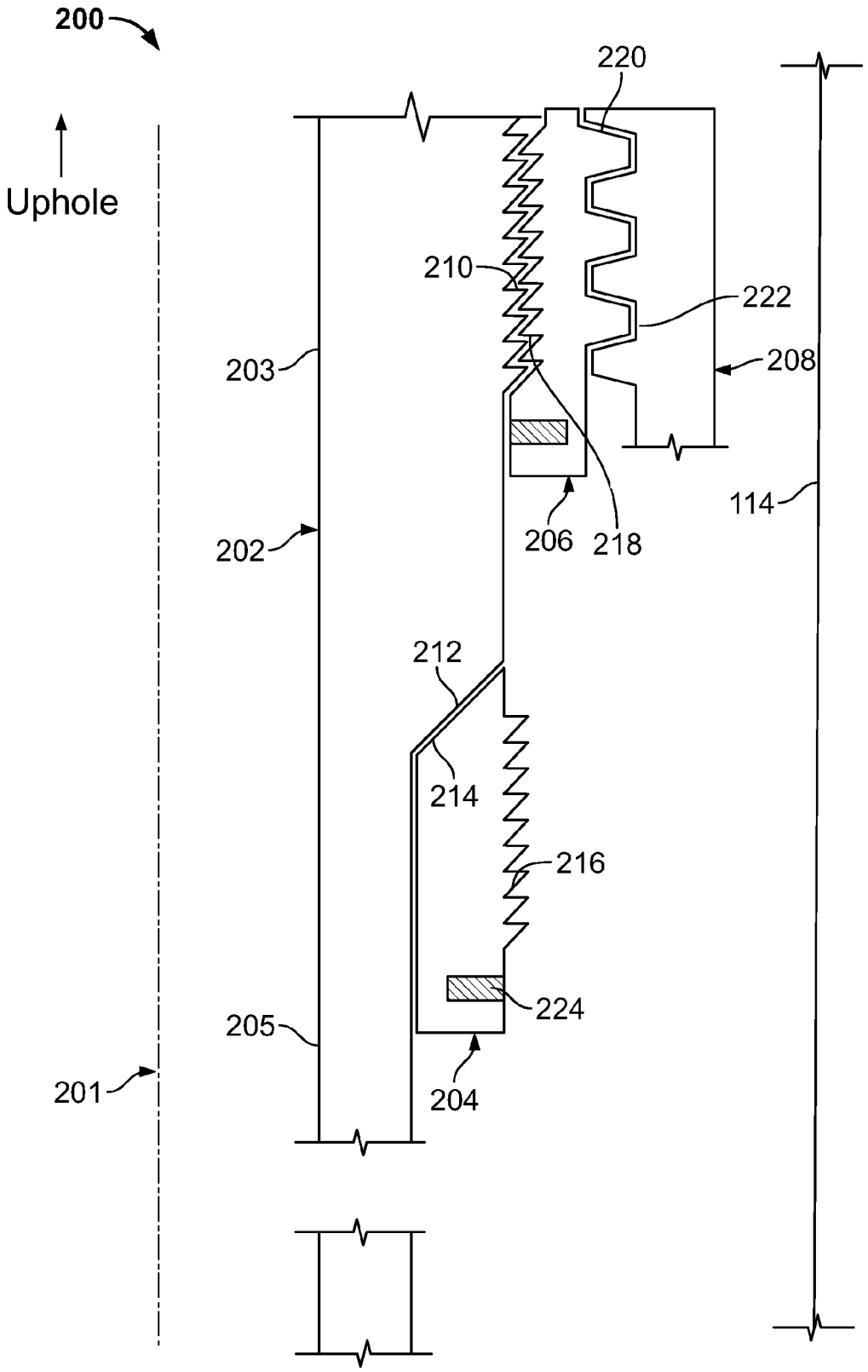

FIGS. 2A-2B illustrate a schematic cross-section view of a portion of an example locking system 200. Locking system 200, in this example, may facilitate a temporary, partial set of a downhole tool coupled to the locking system 200 in a downhole tool string. The downhole tool could include, for instance, a packer, a tubing anchor, a hangers, a bridge plug, a travel joint or otherwise. In the example implementation of the locking system 200, multiple partial sets of the downhole tool may be achieved prior to a final setting location. For example, the locking system 200 may facilitate a partial set of the downhole tool without fully engaging a body lock ring 206. In the example implementation of locking system 200, the downhole tool may be set by a timed sequential setting or axial movement in multiple directions (e.g., uphole and downhole).

Locking system 200 includes a tubular mandrel 202 that includes a first diameter portion 203 separated from a second diameter 205 portion by a no go shoulder 212. The first diameter portion 203, as shown, is thicker (e.g., has a greater wall thickness of the mandrel 202) than the second diameter portion 205, and also includes a section of mandrel teeth 210 machined into an outer radial surface of the first diameter portion 203. The mandrel 202 extends uphole and downhole in a downhole tool string and defines a bore 201 that extends through the string (e.g., for fluid production or circulation).

As illustrated, a carrier ring 204 is positioned adjacent the second diameter portion 205 of the mandrel 202 and allowed to ride, or float, over the portion 205. The carrier ring 204 includes a shoulder 214 that abuts the no go shoulder 212 as the carrier ring 204 moves to close a stroke distance 226 (adjustable) between the carrier ring 204 and the first diameter portion 203 of the mandrel 202. The carrier ring 204 includes carrier ring teeth 216 machined or formed into an outer radial surface of the carrier ring 204.

The body lock ring 206 is positioned, in a partial-set state shown in FIG. 2A, to engage and ride on the carrier ring 204 by engagement of body lock ring teeth 218 engaged with the carrier ring teeth 216. Further, a shear member 224 couples the carrier ring 204 and the body lock ring 206 in the partial-set state shown in FIG. 2A. The body lock ring teeth 218 are machined or formed onto an inner radial surface of the body lock ring 206. The body lock ring 206 also includes a tooth profile 220 formed or machined into an outer radial surface of the body lock ring 206.

In the illustrated example, a housing 208 engages the body lock ring 206 through engagement of a tooth profile 222 formed on an inner radial surface of the housing 208 that engages with the tooth profile 220. The housing 208, in this example, may be part of or coupled to the downhole tool that is to be set by the locking system 200. Thus, movement of one or more components of the locking system 200, as described herein, may adjust the housing 208, thereby partially or fully setting the downhole tool (e.g., packer, bridge plug, hanger, or otherwise).

In operation, the locking system 200 facilitates a partial and full set of the downhole tool coupled to the system 200. For example, as shown in FIG. 2A, the locking system 200 is in a partial set state in which the carrier ring 204 may ride bi-directionally over the mandrel 202 to adjust the housing 208. Here, force exerted on the housing 208 (e.g., by fluid pressure, mechanical contact, or otherwise) adjusts the position of the carrier ring 204 on the second diameter portion 205 of the mandrel 202. This force applied to the housing 208 may adjust the locking system 200 into a particular location for a partial set of the downhole tool. But because the body lock ring 206 remains engaged with the carrier ring 204 in this state, a full set (e.g., in which the body lock ring 206 is engaged with the mandrel 202) may not occur. In an alternative aspect, force may also be applied to the mandrel 202 in a downhole direction (e.g., rather than force applied to the housing 208 in an uphole direction) to adjust the locking system 200 into a particular location for a partial set of the downhole tool.

As shown in the partial set state of FIG. 2A, the carrier ring 204 is free to ride on the second diameter portion 205 of the mandrel 202 based on force exerted on the housing 208. Thus, the locking system 200 may be partially set in multiple positions, and at multiple time instances without locking the set position relative to the tooth profile 210 on the mandrel 202.

FIG. 2B illustrates the locking system 200 in a fully set position or state. In this state, the body lock ring 206 is engaged with the mandrel 202 to place the housing 208 (and thus downhole tool) in a fully set position. To move from a partial set state to the fully set state, the force on the housing 208 continues to push the carrier ring 204 toward the no go shoulder 212 until the carrier shoulder 214 abuts the no go shoulder 212. As force continues on the housing 208 at a magnitude sufficient to shear the shear member 224, the body lock ring teeth 218 disengage the carrier ring teeth 216 and the body lock ring 206 is free to move over the mandrel 202. As shown, the corresponding teeth (or profile) of the carrier ring 204 and the body lock ring 206 are oriented so that movement of the body lock ring 206 is possible in one direction (e.g., in this example, uphole).

As the body lock ring 206 moves over the mandrel 202, the body lock ring teeth 218 engage the mandrel teeth 210 to place the locking system 200 into the fully set state. Subsequently, the housing 208 and downhole tool are in a fully set state, with the downhole tool ready to operate as designed (e.g., as a packer, plug, hanger, or otherwise) at the correct, final position in the wellbore 114.

Figure 3A:
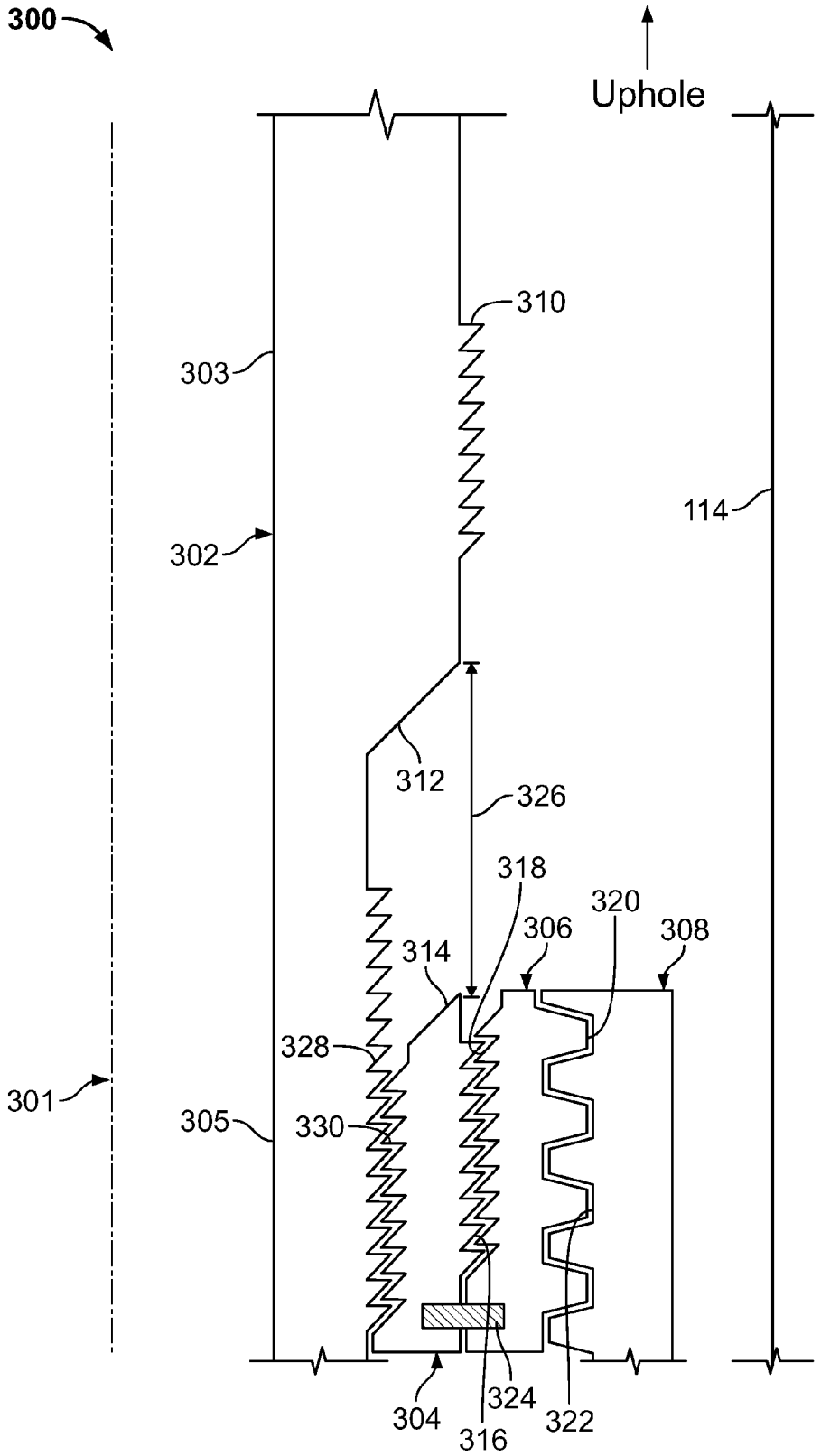
FIGS. 3A-3C illustrate a schematic cross-section view of a portion of another example locking system.
Figure 3B:
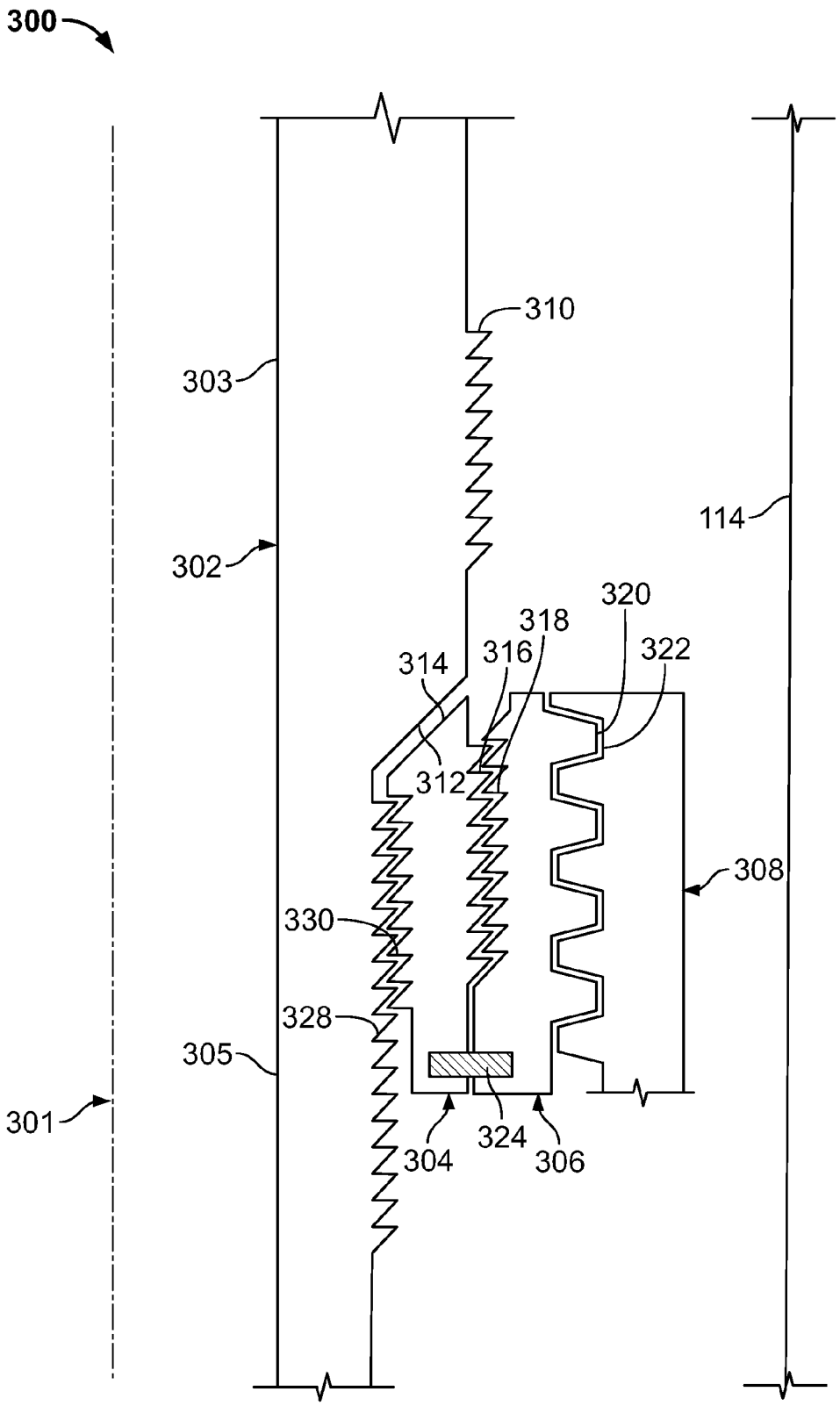
Figure 3C:
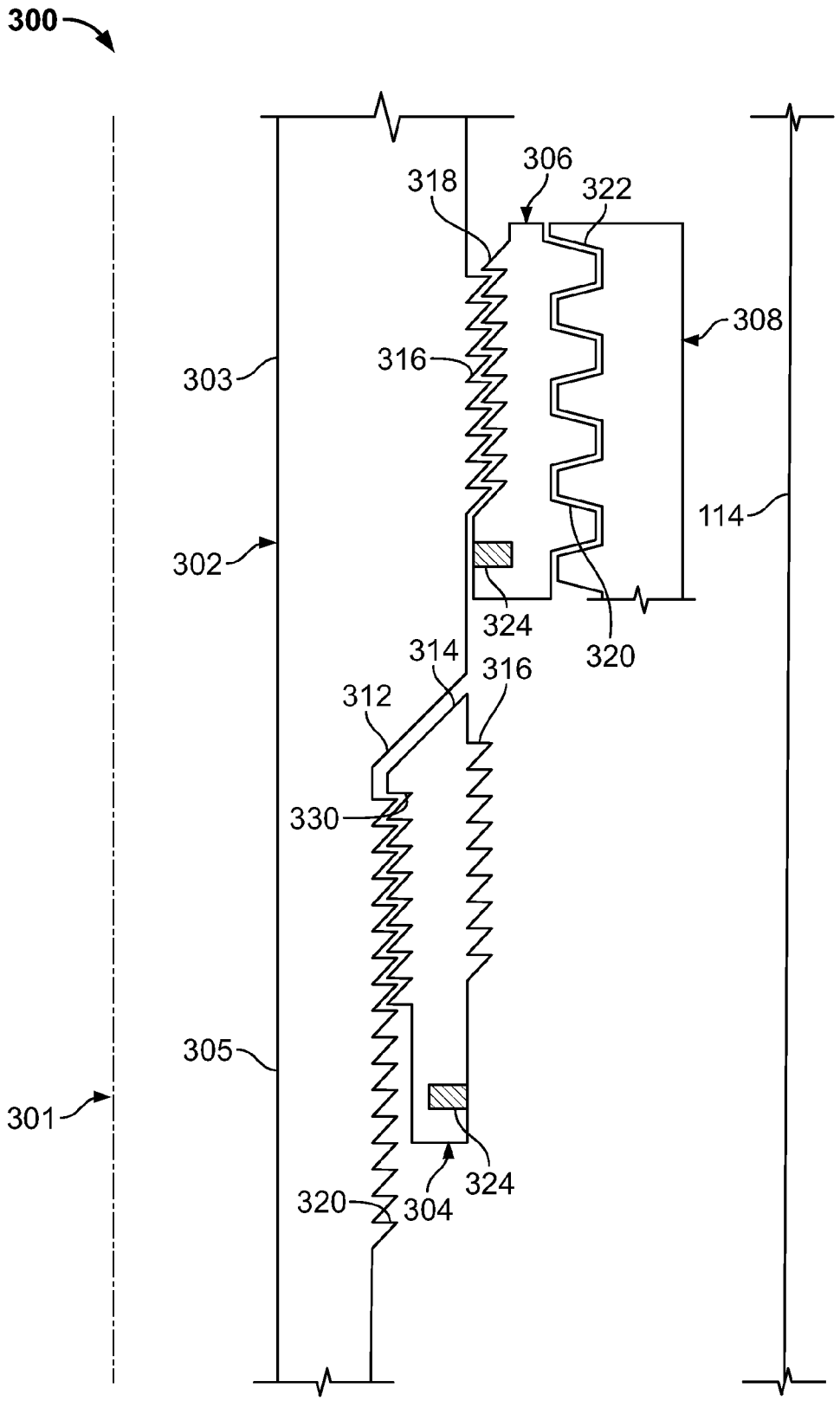

FIGS. 3A-3C illustrate a schematic cross-section view of a portion of another example locking system 300. Locking system 300, in this example, may facilitate a temporary, partial set of a downhole tool coupled to the locking system 300 in a downhole tool string. The downhole tool could include, for instance, a packer, a tubing anchor, a hangers, a bridge plug, a travel joint or otherwise. In the example implementation of the locking system 300, multiple partial sets of the downhole tool may be achieved prior to a final setting location. For example, the locking system 300 may facilitate a partial set of the downhole tool without fully engaging a body lock ring 306. In the example implementation of locking system 300, the downhole tool may be set by a timed sequential setting or axial movement in a single direction (e.g., uphole or downhole).

Locking system 300 includes a tubular mandrel 302 that includes a first diameter portion 303 separated from a second diameter 305 portion by a no go shoulder 312. The first diameter portion 303, as shown, is thicker (e.g., has a greater wall thickness of the mandrel) than the second diameter portion 305, and also includes a section of mandrel teeth 310 machined into an outer radial surface of the first diameter portion 303. The mandrel 302 extends uphole and downhole in a downhole tool string and defines a bore 301 that extends through the string (e.g., for fluid production or circulation). As illustrated, the second diameter portion 305 also includes mandrel teeth 328.

As illustrated, a carrier ring 304 is positioned adjacent the second diameter portion 305 of mandrel 302 and engaged, with carrier ring teeth 330 formed on the inner radial surface of the carrier ring 304, to the mandrel teeth 328 of the second diameter portion 305 of mandrel 302. The carrier ring 304 includes a shoulder 314 that abuts the no go shoulder 312 as the carrier ring 304 moves to close a stroke distance 326 (adjustable) between the carrier ring 304 and the first diameter portion 303 of the mandrel 302. The carrier ring 304 includes carrier ring teeth 316 machined or formed into an outer radial surface of the carrier ring 304.

The body lock ring 306 is positioned, in a partial-set state shown in FIG. 3A, to engage and ride on the carrier ring 304 by engagement of body lock ring teeth 318 engaged with the carrier ring teeth 316. Further, a shear member 324 couples the carrier ring 304 and the body lock ring 306 in the partial-set state shown in FIG. 3A. The body lock ring teeth 318 are machined or formed onto an inner radial surface of the body lock ring 306. The body lock ring 306 also includes a tooth profile 320 formed or machined into an outer radial surface of the body lock ring 306.

In the illustrated example, a housing 308 engages the body lock ring 306 through engagement of a tooth profile 322 formed on an inner radial surface of the housing 308 that engages with the tooth profile 320. The housing 308, in this example, may be part of or coupled to the downhole tool that is to be set by the locking system 300. Thus, movement of one or more components of the locking system 300, as described herein, may adjust the housing 308, thereby partially or fully setting the downhole tool (e.g., packer, bridge plug, hanger, or otherwise).

In operation, the locking system 300 facilitates a partial and full set of the downhole tool coupled to the system 300. For example, as shown in FIG. 3A, the locking system 300 is in a first partial set state in which the carrier ring 304 may move uni-directionally over the mandrel 302 to adjust the housing 308. Here, force exerted on the housing 308 (e.g., by fluid pressure, mechanical contact, or otherwise) adjusts the position of the carrier ring 304 on the second diameter portion 305 of the mandrel 302, e.g., pushes the carrier ring teeth 330 over the mandrel teeth 328 in an uphole direction. This force applied to the housing 308 may adjust the locking system 300 into a particular location for a partial set of the downhole tool. But because the body lock ring 306 remains engaged with the carrier ring 304 in this state, a full set (e.g., in which the body lock ring 306 is engaged with the mandrel 302) is not achieved.

As shown in the partial set state of FIG. 3A, the carrier ring 304 may move in one direction over the mandrel 304 based on force exerted on the housing 308. Thus, while the locking system 300 may be partially set in multiple positions, and at multiple time instances, the carrier ring 304 may only move in one direction relative to the mandrel 302 based on engagement of the teeth 328 and 330, which are oriented to permit single direction, relative movement.

FIG. 3B illustrates the locking system 300 in a second partial set position or state. As with the first partial set state, the carrier ring 304 has moved uni-directionally over the mandrel 302 closer to the no go shoulder 312 to adjust the housing 308. Here, the force exerted on the housing 308 further adjusts the position of the carrier ring 304 on the second diameter portion 305 of the mandrel 302. By facilitating multiple partial sets while also preventing movement in a particular direction of the carrier ring 304 (e.g., due to engagement with the mandrel teeth 328), the downhole tool may be set, initially operated, and then moved to another partial set position by the locking system 300.

FIG. 3C shows the locking system in a final set state or position. In this state, the body lock ring 306 is engaged with the mandrel 302 to place the housing 308 (and thus downhole tool) in a fully set position. To move from a particular partial set state to the fully set state, the force on the housing 308 continues to push the carrier ring 304 toward the no go shoulder 312 until the carrier shoulder 314 abuts the no go shoulder 312. As force continues on the housing 308 at a magnitude sufficient to shear the shear member 324, the body lock ring teeth 318 disengage the carrier ring teeth 316 and the body lock ring 306 is free to move over the mandrel 302. As shown, the corresponding profiles of the carrier ring 304 and the body lock ring 306 are oriented so that movement of the body lock ring 306 is possible in one direction (e.g., in this example, uphole). In an alternative aspect, force may be applied to the mandrel 302 in a downhole direction to create relative movement between the mandrel 302 and the carrier ring 304. Thus, a force (at a sufficient magnitude) on the mandrel 302 rather than the housing 308 may shear the shear member 324 to disengage the body lock ring teeth 318 from the carrier ring teeth 316. Then the body lock ring 306 is free to move over the mandrel 302.

As the body lock ring 306 moves over the mandrel 302, the body lock ring teeth 318 engage the mandrel teeth 310 to place the locking system 300 into the fully set state. Subsequently, the housing 308 and downhole tool are in a fully set state, with the downhole tool ready to operate as designed (e.g., as a packer, plug, hanger, or otherwise) at the correct, final position in the wellbore 114.

Figure 4:
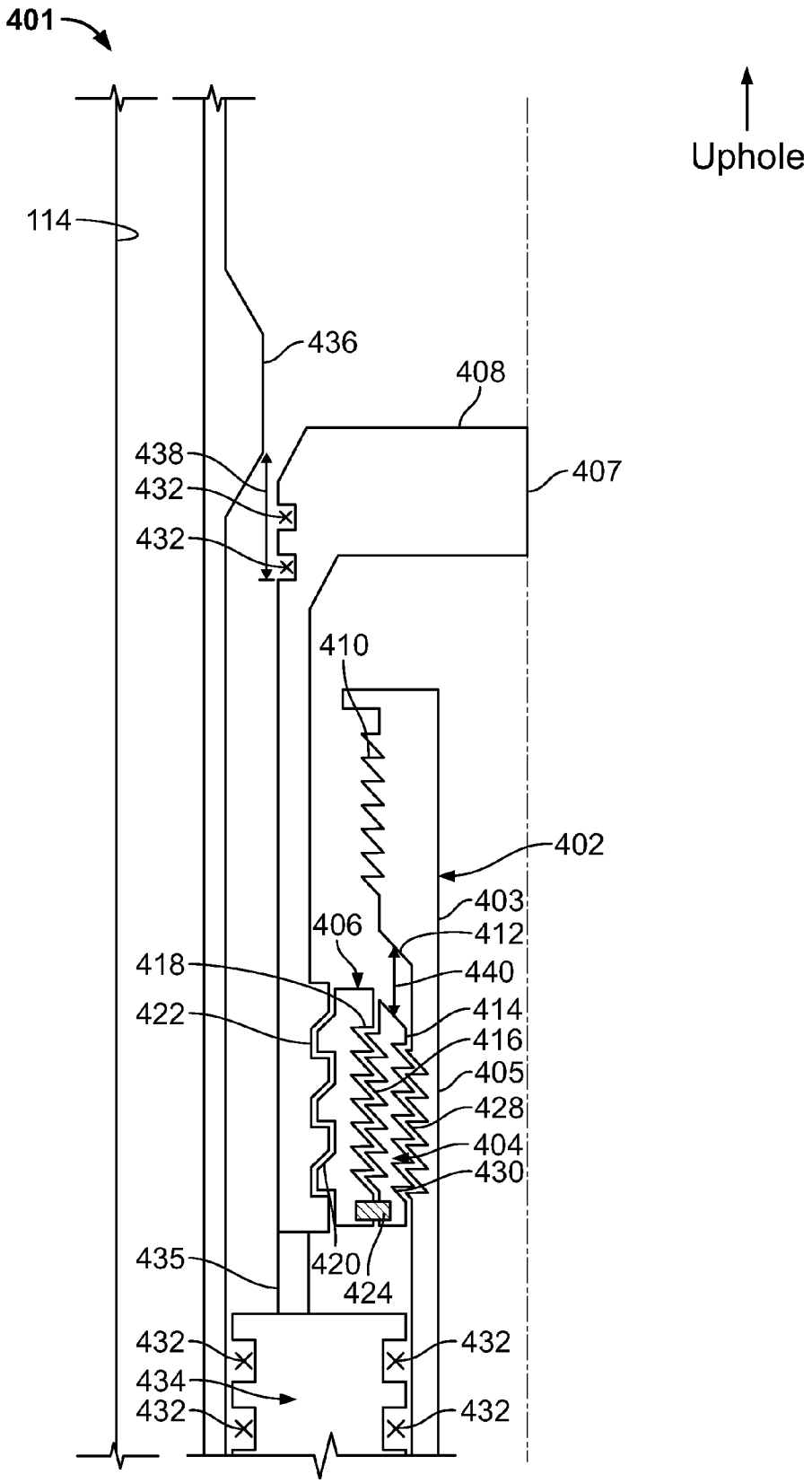
FIG. 4 illustrates a schematic cross-section view of a portion of another example locking system.

FIG. 4 illustrates a schematic cross-section view of a portion of another example locking system 400. The locking system 400, in some aspects, is similar to locking system 300 in that teeth or a profile are formed or machined into an outer radial surface of an inner mandrel 402 and an inner radial surface of a carrier ring 404. In this example, a fluid pressure is used to adjust the locking system 400 from a partial set state to another (or other) partial set state(s) as well as a final set state.

Locking system 400 includes a tubular inner mandrel 402 that includes a first diameter portion 403 separated from a second diameter 405 portion by a no go shoulder 412. The first diameter portion 403, as shown, is thicker than the second diameter portion 405, and also includes a section of mandrel teeth 410 machined into an outer radial surface of the first diameter portion 403. The inner mandrel 402 extends uphole and downhole in a downhole tool string and defines a bore 401 that extends through the string (e.g., for fluid production or circulation). As illustrated, the second diameter portion 405 also includes mandrel teeth 428.

As illustrated, a carrier ring 404 is positioned adjacent the second diameter portion 405 of the mandrel 402 and engaged, with carrier ring teeth 430 formed on the inner radial surface of the carrier ring 404, to the mandrel teeth 428 of the mandrel 402. The carrier ring 404 includes a shoulder 414 that abuts the no go shoulder 412 as the carrier ring 404 moves to close a stroke distance 440 (adjustable) between the carrier ring 404 and the first diameter portion 403 of the inner mandrel 402. The carrier ring 404 includes carrier ring teeth 416 machined or formed into an outer radial surface of the carrier ring 404.

The body lock ring 406 is positioned, in a partial-set state shown in FIG. 4, to engage and ride on the carrier ring 404 by engagement of body lock ring teeth 418 engaged with the carrier ring teeth 416. Further, a shear member 424 couples the carrier ring 404 and the body lock ring 406 in the partial-set state shown in FIG. 4. The body lock ring teeth 418 are machined or formed onto an inner radial surface of the body lock ring 406. The body lock ring 406 also includes a tooth profile 420 formed or machined into an outer radial surface of the body lock ring 406.

In the illustrated example, a housing 408 engages the body lock ring 406 through engagement of a tooth profile 422 formed on an inner radial surface of the housing 408 that engages with the tooth profile 420. The housing 408, in this example, may be part of or coupled to the downhole tool that is to be set by the locking system 400. Thus, movement of one or more components of the locking system 400, as described herein, may adjust the housing 408, thereby partially or fully setting the downhole tool (e.g., packer, bridge plug, hanger, or otherwise).

As illustrated, a fluid chamber 434 is positioned, in this example, adjacent a downhole end of the housing 408 and sealed between the inner mandrel 402 and a tubular outer mandrel 436 by seals 432. Thus, fluid may be circulated to the chamber 434 to cause a piston 435 to urge the housing 408 uphole, and as described herein, shear the shear member 424 to put the locking system 400 into a final set state.

Although FIG. 4 illustrates one example orientation of the locking system 400, there may be other alternative orientations. For example, in another example orientation, the illustrated components may be reversed in direction. Housing 408 may then face downhole so that the locking system 400 may act as a plug to plug surges in pressure from a subterranean zone. For example, the system 400 may be run into the wellbore with the housing 408 (e.g., a radial extending end 407 of the housing 408) facing downhole. Pressure may then be supplied to urge the piston 435, which urges the carrier ring 404 coupled with the body lock ring 406 and the housing 408 to stroke the distance 440 (e.g., in a downhole direction). This will also case the housing 408 to move (e.g., the distance 438) adjacent to the increased diameter portion of the outer mandrel 436 to plug the seals 432 and plug the wellbore. When the wellbore needs to be unsealed, the piston 435 may be further pressured (e.g., by fluid in the chamber 434) to release the seals 432 from the increased diameter portion of the outer mandrel 436. This may be accomplished by urging the body lock ring 406 to the first diameter portion 403 of the mandrel 402 (e.g., onto the mandrel teeth 410).

In some aspects, the stroke distances 438 and 440 may not be equal, but may be different depending on system setting requirements. For example, the seal of 432 on the outer mandrel 436 can happen when the locking system 400 moves into the fully set state. In some aspects, the stroke length 438 in this example represents a distance traveled by the housing 408 to seal within a secondary seal bore (e.g., here, the outer mandrel 436) as the locking system 400 moves into a fully set state. Thus, the stroke distance 438 may be specified so that the distance traveled may obtain seal integrity in the system, if designed to have seal integrity at full set, or may be specified so that the distance traveled loses seal integrity achieves a pressure balanced communication in a fully set state.

In an example operation, the locking system 400 facilitates a partial and full set of the downhole tool coupled to the system 400. For example, as shown in FIG. 4, the locking system 400 is in a first partial set state in which the carrier ring 404 may move uni-directionally over the inner mandrel 402 to adjust the housing 408. Here, force exerted on the housing 408 (e.g., by fluid pressure through fluid chamber 434) adjusts the position of the carrier ring 404 on the second diameter portion 405 of the inner mandrel 402, e.g., pushes the carrier ring teeth 430 over the mandrel teeth 428 in an uphole direction. This force applied to the housing 408 may adjust the locking system 400 into a particular location for a partial set of the downhole tool. But because the body lock ring 406 remains engaged with the carrier ring 404 in this state, a full set (e.g., in which the body lock ring 406 is engaged with the inner mandrel 402) is not achieved.

As shown in the partial set state of FIG. 4, the carrier ring 404 may move in one direction over the inner mandrel 402 based on force exerted on the housing 408. Thus, while the locking system 400 may be partially set in multiple positions, and at multiple time instances, the carrier ring 404 may only move in one direction relative to the inner mandrel 402 based on engagement of the teeth 428 and 430, which are oriented to permit single direction, relative movement.

As described previously with reference to locking system 300, the locking system 400 may be adjusted, based on fluid pressure in pressure chamber 434, to a second partial set position or state. As with the first partial set state, the carrier ring 404 moves uni-directionally over the inner mandrel 402 closer to the no go shoulder 412 to adjust the housing 408. Here, the force exerted on the housing 408 further adjusts the position of the carrier ring 404 on the second diameter portion 405 of the inner mandrel 402. By facilitating multiple partial sets while also preventing movement in a particular direction of the carrier ring 404 (e.g., due to engagement with the mandrel teeth 428), the downhole tool may be set, initially operated, and then moved to another partial set position by the locking system 400.

The locking system 400 may be adjusted to a final set state or position similarly to locking system 300. In this state, the body lock ring 406 is engaged with the inner mandrel 402 to place the housing 408 (and thus downhole tool) in a fully set position. To move from a particular partial set state to the fully set state, the force on the housing 408 continues to push the carrier ring 404 toward the no go shoulder 412 until the carrier shoulder 414 abuts the no go shoulder 412. As force continues on the housing 408 at a magnitude sufficient to shear the shear member 424, the body lock ring teeth 418 disengage the carrier ring teeth 416 and the body lock ring 406 is free to move over the inner mandrel 402. As shown, the corresponding profiles of the carrier ring 404 and the body lock ring 406 are oriented so that movement of the body lock ring 406 is possible in one direction (e.g., in this example, uphole).

As the body lock ring 406 moves over the inner mandrel 402, the body lock ring teeth 418 engage the mandrel teeth 410 to place the locking system 400 into the fully set state. Subsequently, the housing 408 and downhole tool are in a fully set state, with the downhole tool ready to operate as designed (e.g., as a packer, plug, hanger, or otherwise) at the correct, final position in the wellbore 114.

Various implementations have been described in the present disclosure. In an example implementation, a downhole tool locking system includes a tubular mandrel that defines a bore therethrough, the mandrel including a profile formed on an outer radial surface of the mandrel; a carrier ring positioned to ride the tubular mandrel adjacent an outer radial surface of the tubular mandrel, the carrier ring including a profile formed on an outer radial surface of the carrier ring; a body lock ring including a first profile formed on an inner radial surface to engage the profile formed on the outer radial surface of the carrier ring, and a second profile formed on an outer radial surface of the body lock ring; and a housing including a profile formed on an inner radial surface of the housing to engage the second profile of the body lock ring.

In a first aspect combinable with the example implementation, the body lock ring is adjustable from a first position engaged with the carrier ring through engagement of the carrier ring profile and the first profile of the body lock ring to a second position engaged with the mandrel through engagement of the mandrel profile and the first profile of the body lock ring, based on a specified force applied to the housing, to adjust a downhole tool coupled to the housing from a partial set position to a fully set position.

In a second aspect combinable with any of the previous aspects, wherein the carrier ring is configured to bi-directionally ride on a portion of the outer radial surface of the mandrel in response to the force applied to the housing.

In a third aspect combinable with any of the previous aspects, wherein the body lock ring is adjustable from the first position engaged with the carrier ring through engagement of the carrier ring profile and the first profile of the body lock ring to a third position engaged with the carrier ring through engagement of the carrier ring profile and the first profile of the body lock ring based on adjustment of the carrier ring on the mandrel in response to the force applied to the housing, the third position including another partial set position of the downhole tool.

In a fourth aspect combinable with any of the previous aspects, the profile formed on the outer radial surface of the mandrel includes a first mandrel profile.

In a fifth aspect combinable with any of the previous aspects, the mandrel further includes a second mandrel profile formed on the outer radial surface of the mandrel, and the carrier ring further includes a profile formed on an inner radial surface of the carrier ring to engage the second profile.

In a sixth aspect combinable with any of the previous aspects, the first mandrel profile is formed on a first diameter portion of the mandrel, and the second mandrel profile is formed on a second diameter portion of the mandrel.

In a seventh aspect combinable with any of the previous aspects, the first diameter portion of the mandrel including a greater mandrel wall thickness than the second diameter portion.

In an eighth aspect combinable with any of the previous aspects, the first diameter portion transitions to the first diameter portion by a no go shoulder that ramps between the first and second diameter portions.

A ninth aspect combinable with any of the previous aspects further includes a shear member that couples the carrier ring to the body lock ring.

In a tenth aspect combinable with any of the previous aspects, the shear member is configured to shear to release the body lock ring from the carrier ring based on the specified force applied to the housing.

In another example implementation, a method for setting a downhole tool includes applying a first force to a tubular housing coupled, through a body lock ring, with a carrier ring that rides on a mandrel; adjusting the carrier ring and the body lock ring on the mandrel to a first set position based on the first force applied to the housing; based on the carrier ring and body lock ring adjusted to the first set position, setting a downhole tool coupled to the tubular housing at a partial set location in a wellbore; applying a second force to the tubular housing to decouple the carrier ring from the body lock ring; adjusting the body lock ring on the mandrel to a second set position based on the second force applied to the housing; and based on the body lock ring adjusted to the second set position, setting the downhole tool coupled to the tubular housing at a final set location in the wellbore.

A first aspect combinable with the example implementation further includes applying a third force to the tubular housing coupled, through the body lock ring, with the carrier ring that rides on the mandrel; and adjusting the carrier ring and the body lock ring on the mandrel to a third set position based on the third force applied to the housing.

A second aspect combinable with any of the previous aspects further includes based on the carrier ring and body lock ring adjusted to the third set position, setting the downhole tool coupled to the tubular housing at a second partial set location in the wellbore.

In a third aspect combinable with any of the previous aspects, the carrier ring is engaged with a first portion of the mandrel in the first set position, and the body lock ring is engaged with a second portion of the mandrel in the second set position.

In a fourth aspect combinable with any of the previous aspects, the second portion of the mandrel includes a large diameter portion and the first portion of the mandrel includes a small diameter portion.

In a fifth aspect combinable with any of the previous aspects, the large and small diameter portions are separated by a no go shoulder on the mandrel.

In a sixth aspect combinable with any of the previous aspects, adjusting the body lock ring on the mandrel to the second set position based on the second force applied to the housing includes forcing the carrier ring against the no go shoulder, and adjusting the body lock ring onto the second portion of the mandrel from the carrier ring.

In a seventh aspect combinable with any of the previous aspects, applying a second force to the tubular housing to decouple the carrier ring from the body lock ring includes shearing a shear member that couples the carrier ring with the body lock ring.

In an eighth aspect combinable with any of the previous aspects, at least one of the first or second forces includes a fluid pressure of a fluid circulated in the wellbore to the tubular housing.

In another example implementation, a downhole tool setting system includes a tubular member that defines a bore therethrough; a downhole tool positioned to ride the tubular member between a partial set position and a final set position; and a locking system coupled to the downhole tool and configured to adjust the downhole tool from the partial set position based on at least a portion of the locking system moveable relative to the tubular member to the final set position based on at least a portion of the locking system affixed to the tubular member.

In a first aspect combinable with the example implementation, the portion of the locking system moveable relative to the tubular member includes a carrier ring configured to bi-directionally ride on a portion of the outer radial surface of the tubular member in response to a force applied to the locking system.

In a second aspect combinable with any of the previous aspects, the portion of the locking system affixed to the tubular member includes a body lock ring configured to uni-directionally ride on a portion of the outer radial surface of the tubular member in response to another force applied to the locking system.

In a third aspect combinable with any of the previous aspects, the portion of the locking system moveable relative to the tubular member includes a carrier ring configured to uni-directionally ride on a portion of the outer radial surface of the tubular member in response to a force applied to the locking system.

In a fourth aspect combinable with any of the previous aspects further includes a shear member that couples the portion of the locking system moveable relative to the tubular member to the portion of the locking system affixed to the tubular member.

A number of implementations have been described. Nevertheless, it will be understood that various modifications may be made. For example, example operations, methods, or processes described herein may include more steps or fewer steps than those described. Further, the steps in such example operations, methods, or processes may be performed in different successions than that described or illustrated in the figures. As another example, although certain implementations described herein may be applicable to tubular systems (e.g., drillpipe or coiled tubing), implementations may also utilize other systems, such as wireline, slickline, e-line, wired drillpipe, wired coiled tubing, and otherwise, as appropriate. Accordingly, other implementations are within the scope of the following claims.

What is claimed is:

1. A downhole tool locking system, comprising:

a tubular mandrel that defines a bore therethrough, the mandrel comprising a profile formed on an outer radial surface of the mandrel;

a carrier ring positioned to ride the tubular mandrel adjacent an outer radial surface of the tubular mandrel, the carrier ring comprising a profile formed on an outer radial surface of the carrier ring;

a body lock ring comprising a first profile formed on an inner radial surface to engage the profile formed on the outer radial surface of the carrier ring, and a second profile formed on an outer radial surface of the body lock ring; and a housing comprising a profile formed on an inner radial surface of the housing to engage the second profile of the body lock ring, where the body lock ring is adjustable from a first position engaged with the carrier ring through engagement of the carrier ring profile and the first profile of the body lock ring to a second position engaged with the mandrel through engagement of the mandrel profile and the first profile of the body lock ring, based on a specified force applied to the housing, to adjust a downhole tool coupled to the housing from a partial set position to a fully set position.

2. The downhole tool locking system of claim 1, wherein the carrier ring is configured to bi-directionally ride on a portion of the outer radial surface of the mandrel in response to the force applied to the housing.

3. The downhole tool locking system of claim 2, wherein the body lock ring is adjustable from the first position engaged with the carrier ring through engagement of the carrier ring profile and the first profile of the body lock ring to a third position engaged with the carrier ring through engagement of the carrier ring profile and the first profile of the body lock ring based on adjustment of the carrier ring on the mandrel in response to the force applied to the housing, the third position comprising another partial set position of the downhole tool.

4. The downhole tool locking system of claim 1, wherein the profile formed on the outer radial surface of the mandrel comprises a first mandrel profile, the mandrel further comprises a second mandrel profile formed on the outer radial surface of the mandrel, and the carrier ring further comprises a profile formed on an inner radial surface of the carrier ring to engage the second profile.

5. The downhole tool locking system of claim 4, wherein the first mandrel profile is formed on a first diameter portion of the mandrel, and the second mandrel profile is formed on a second diameter portion of the mandrel, the first diameter portion of the mandrel comprising a greater mandrel wall thickness than the second diameter portion.

6. The downhole tool locking system of claim 5, wherein the first diameter portion transitions to the first diameter portion by a no go shoulder that ramps between the first and second diameter portions.

7. The downhole tool locking system of claim 1, further comprising a shear member that couples the carrier ring to the body lock ring, the shear member configured to shear to release the body lock ring from the carrier ring based on the specified force applied to the housing.

8. A method for setting a downhole tool, comprising:

applying a first force to a tubular housing coupled, through a body lock ring, with a carrier ring that rides on a mandrel;

adjusting the carrier ring and the body lock ring on the mandrel to a first set position based on the first force applied to the housing;

based on the carrier ring and body lock ring adjusted to the first set position, setting a downhole tool coupled to the tubular housing at a partial set location in a wellbore;

applying a second force to the tubular housing to decouple the carrier ring from the body lock ring;

adjusting the body lock ring on the mandrel to a second set position based on the second force applied to the housing; and based on the body lock ring adjusted to the second set position, setting the downhole tool coupled to the tubular housing at a final set location in the wellbore.

9. The method of claim 8, further comprising:

applying an intermediate force to the tubular housing coupled, through the body lock ring, with the carrier ring that rides on the mandrel; and adjusting the carrier ring and the body lock ring on the mandrel to an intermediate set position based on the intermediate force applied to the housing.

10. The method of claim 9, further comprising based on the carrier ring and body lock ring adjusted to the intermediate set position, setting the downhole tool coupled to the tubular housing at a second partial set location in the wellbore.

11. The method of claim 8, wherein the carrier ring is engaged with a first portion of the mandrel in the first set position, and the body lock ring is engaged with a second portion of the mandrel in the second set position.

12. The method of claim 11, wherein the second portion of the mandrel comprises a large diameter portion and the first portion of the mandrel comprises a small diameter portion, and the large and small diameter portions are separated by a no go shoulder on the mandrel.

13. The method of claim 11, wherein adjusting the body lock ring on the mandrel to the second set position based on the second force applied to the housing comprises forcing the carrier ring against the no go shoulder, and adjusting the body lock ring onto the second portion of the mandrel from the carrier ring.

14. The method of claim 8, wherein applying a second force to the tubular housing to decouple the carrier ring from the body lock ring comprises shearing a shear member that couples the carrier ring with the body lock ring.

15. The method of claim 8, wherein at least one of the first or second forces comprises a fluid pressure of a fluid circulated in the wellbore to the tubular housing.

16. A downhole tool setting system, comprising:

a tubular member that defines a bore therethrough;

a downhole tool positioned to ride the tubular member between a partial set position and a final set position;

a locking system coupled to the downhole tool and configured to adjust the downhole tool from the partial set position based on a carrier ring moveable relative to the tubular member to the final set position based on at least a portion of the locking system affixed to the tubular member; and a shear member that couples the carrier ring moveable relative to the tubular member to the portion of the locking system affixed to the tubular member.

17. The downhole tool setting system of claim 16, wherein the carrier ring is configured to bi-directionally ride on a portion of the outer radial surface of the tubular member in response to a force applied to the locking system.

18. The downhole tool setting system of claim 17, wherein the portion of the locking system affixed to the tubular member comprises a body lock ring configured to uni-directionally ride on a portion of the outer radial surface of the tubular member in response to another force applied to the locking system.

19. The downhole tool setting system of claim 16, wherein the carrier ring is configured to uni-directionally ride on a portion of the outer radial surface of the tubular member in response to a force applied to the locking system.

* * * * *